US009612074B2

(12) United States Patent
Ellis et al.

(10) Patent No.: US 9,612,074 B2
(45) Date of Patent: Apr. 4, 2017

(54) LESS-LETHAL FORCE DEVICE IMPACT RATIO

(71) Applicants: Christian Ellis, Poway, CA (US); Ben Weinrib, San Diego, CA (US); Bruce A Timan, Pine Valley, CA (US)

(72) Inventors: Christian Ellis, Poway, CA (US); Ben Weinrib, San Diego, CA (US); Bruce A Timan, Pine Valley, CA (US)

( * ) Notice: Subject to any disclaimer, the term of this patent is extended or adjusted under 35 U.S.C. 154(b) by 505 days.

(21) Appl. No.: 14/183,455

(22) Filed: Feb. 18, 2014

(65) Prior Publication Data

US 2016/0223280 A1 Aug. 4, 2016

Related U.S. Application Data

(60) Provisional application No. 61/766,887, filed on Feb. 20, 2013.

(51) Int. Cl.

| | |
|---|---|
| ***F42B 10/00*** | (2006.01) |
| ***F42B 12/00*** | (2006.01) |
| ***F41A 21/32*** | (2006.01) |
| ***F42B 12/36*** | (2006.01) |
| ***F42B 12/74*** | (2006.01) |
| ***F42B 30/04*** | (2006.01) |
| ***F42B 30/06*** | (2006.01) |
| ***F41F 7/00*** | (2006.01) |
| ***F41A 21/34*** | (2006.01) |

(52) U.S. Cl.

CPC ..... *F41A 21/32* (2013.01); *F41A 21/34* (2013.01); *F41F 7/00* (2013.01); *F42B 12/36* (2013.01); *F42B 12/74* (2013.01); *F42B 12/745* (2013.01); *F42B 30/04* (2013.01); *F42B 30/06* (2013.01)

(58) Field of Classification Search

CPC ..... F41A 21/32; F41A 21/34; F42B 12/02
USPC ..... 102/485; 42/105
See application file for complete search history.

(56) References Cited

U.S. PATENT DOCUMENTS

| | | | | |
|---|---|---|---|---|
| 1,900,790 A * | 3/1933 | Brandt | F42B 12/42 | 102/253 |
| 3,307,283 A * | 3/1967 | Cox | F41C 27/06 | 42/105 |
| 3,491,693 A | 1/1970 | Streckfuss et al. | | |
| 3,620,162 A * | 11/1971 | King | F42B 30/06 | 102/485 |

(Continued)

FOREIGN PATENT DOCUMENTS

| | | |
|---|---|---|
| FR | 604510 | 5/1926 |
| WO | 0111305 | 2/2001 |

*Primary Examiner* — Samir Abdosh

(74) *Attorney, Agent, or Firm* — Kirk A. Buhler; Buhler & Associates

(57) ABSTRACT

Improvements in a less-lethal force device are disclosed. The less-lethal projectile device generally comprising a projectile, such as a rubber-encapsulated metal block, that is mated to a docking base by way of a mounting pins or base. The projectile may be made with a cavity located in its rearward section for enabling the projectile to fit onto the mounting pins portion of the docking base through compression or interference fit. The projectile captures a fired bullet and is propelled along the original path of the bullet at a less lethal velocity. The disclosed system results in converting a normally lethal weapon into a less-lethal blunt impact system. The mounting pins are configured to provide clearance to the sighting mechanism on the firearm.

16 Claims, 9 Drawing Sheets

(56) References Cited

U.S. PATENT DOCUMENTS 3,664,263 A * 5/1972 Driscoll ..... F41C 27/06 102/485
3,726,036 A * 4/1973 Jennings ..... F42B 30/06 102/485
3,733,727 A 5/1973 Jones et al.
3,791,303 A 2/1974 Sweeney
3,898,932 A * 8/1975 Flatau ..... F42B 12/50 102/502
3,951,070 A * 4/1976 Flatau ..... F42B 12/50 102/502
3,982,489 A * 9/1976 Flatau ..... F42B 12/745 102/502
4,013,011 A 3/1977 Gabriels
4,030,421 A 6/1977 Litman
4,190,476 A * 2/1980 Flatau ..... F42B 12/50 156/218
4,505,179 A 3/1985 Nelson et al.
4,506,604 A 3/1985 Hughes
4,567,831 A 2/1986 Gordon et al.
4,747,349 A 5/1988 Schilling et al.
4,776,255 A 10/1988 Smith
4,793,259 A * 12/1988 Ambrosi ..... F42B 30/04 102/485
4,799,906 A * 1/1989 Perkins, Jr. ..... B63C 9/22 102/504
4,823,702 A 4/1989 Woolsey
4,908,971 A * 3/1990 Chaney ..... F41A 17/44 42/70.11
5,092,071 A * 3/1992 Moore ..... F41G 1/35 42/105
5,099,747 A 3/1992 Smith
5,257,936 A 11/1993 Ambrosi et al.
5,349,906 A 9/1994 Devaux et al.
5,377,438 A 1/1995 Sheinfeld et al.
5,448,937 A 9/1995 Buc et al.
5,574,245 A 11/1996 Buc et al.
5,654,524 A 8/1997 Saxby
6,343,431 B1 * 2/2002 Brunn ..... F41C 27/06 42/105
6,378,439 B1 4/2002 Saxby
6,408,765 B1 6/2002 Tauber et al.
6,523,478 B1 2/2003 Gonzalez et al.
6,619,179 B2 9/2003 Mika
6,688,032 B1 2/2004 Gonzalez et al.
6,981,449 B2 1/2006 Sadeck
7,296,375 B2 11/2007 Brunn
7,526,999 B1 * 5/2009 Timan ..... F41C 27/06 102/502
2003/0019352 A1 1/2003 Mika
2004/0069177 A1 4/2004 Klein
2011/0056364 A1 * 3/2011 Kennedy ..... F41A 21/26 89/14.05
2015/0260494 A1 * 9/2015 Peter ..... F42B 8/12 102/502
2016/0178305 A1 * 6/2016 Ellis ..... F42B 12/02 42/90

* cited by examiner

LESS-LETHAL FORCE DEVICE IMPACT RATIO

CROSS REFERENCE TO RELATED APPLICATIONS

This application claims the benefit of Provisional 61/766,887 filed Feb. 20, 2013 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a less-lethal force device. More particularly, the present disclosure is for an accessory that is used with a law enforcement firearm to convert a lethal projectile into a less-lethal force projectile.

Description of Related Art Including Information Disclosed Under 37 CFR 1.97 and 1.98

Less-lethal weapon systems are well known in the art. Most less-lethal weapons require a complete weapon with a projectile that is included with the weapon. Examples include rubber bullets, electronic restraint devices, and the like. Many existing less-lethal systems do not allow law enforcement officers immediate access to the less-lethal weapon and do not allow law enforcement officers to have quick access to such devices in high-pressure emergency situations.

Less-lethal devices are designed to be used in critical situations, such as crowd control operations outdoors, or when an aggressor must be restrained in residential or public settings, including public transportation settings. Few devices of the prior art can be deployed within such a wide range of circumstances, allowing their use outdoors, indoors, and within confined, populated, and fragile spaces, such as the interior of airliners or businesses. Many devices are subject to a loss of potency, deterioration, or reliability due to age, temperature, and humidity. Finally, many prior art systems subject officers to a period of vulnerability during the transition from lethal, to less-lethal, and back to lethal weaponry.

A number of patents and or publications have been made to address these issues. Exemplary examples of patents and or publication that try to address this/these problem(s) are identified and discussed below.

U.S. Pat. No. 7,526,999 issued May 5, 2009 to Bruce A. Timan discloses a less-lethal Force Device. This device provides early elements of the device found in this disclosure. Use and testing of the product found in this patent has identified a number of improvements that were not obvious in the initial patent. While this patent identifies a less-lethal force device it does not disclose the improvements identified in this application.

U.S. Pat. No. 5,377,438 issued on Jan. 3, 1995 to Naftali Sheinfeld et al., discloses a device for preventing accidental discharging of a bullet from a firearm. This device captures a fires bullet but does not utilize a non-lethal projectile the travels from the firearm. While this patent covers a device to receive a projectile it does not include the features of this pending application.

U.S. Pat. No. 5,654,524 issued Aug. 5, 1997 and U.S. Pat. No. 6,378,439 issued Apr. 30, 2002, both to Michael Ernest Saxby disclose a marker projectile. The projectile includes internal ink or similar marking system where the projectile is propelled by air from a firearm. When the projectile reaches a target the inertia forces the marking substance to mark the target.

U.S. Patent Publication Number 2004/0069177 was published on Apr. 15, 2004 to John M. Klein discloses a Non-Lethal Projectile Ammunition. The projectile has a propellant that propels the projectile. The projectile is filled with an irritant such as pepper or similar medial that disperses upon impact with the ground. While this published application provides an irritant, the ammunition is self-propelled and does not convert a lethal projectile into a non-lethal projectile.

International publication WO 01/11305 was published on Feb. 15, 2001 for Tony Zanti discloses a Nonlethal Projectile Launched by a Lethal Projectile Discharged from a Firearm. The projectile has a series of fins that allow the projectile to fly. The fins prevent the rifling of the lethal projectile from allowing the non-lethal from spinning. The fins further increase the width of the non-lethal projectile thereby making the non-lethal projectile inoperable in a holster.

What is needed is a non-lethal projectile that captures a lethal projectile. The device is inserted over the end of a firearm thereby allowing the lethal firearm from being quickly converted with the use of a docking base. The proposed disclosure provides a solution to the problem.

BRIEF SUMMARY OF THE INVENTION

It is an object of the less-lethal force device to alter the projectile end of a firearm to a color such as Orange to identify that the weapon is less-lethal thereby notifying other law enforcement personnel that the projectile will be less lethal.

It is an object of the less-lethal force device for the projectile to embed in a slug that absorbs the lethal projectile. The slug can be metallic as well as other materials including but not limited to ceramics, composites.

It is an object of the less-lethal force device for the less-lethal projectile to be fabricated in an over-mold technique where the less-lethal projectile is fabricated using two or more materials where a first material is constructed to absorb the lethal projectile and the second material is constructed for impact with a target.

It is an object of the less-lethal force device to include grooves in the slug that help to retain the lethal projectile and improve guiding the lethal projectile into the less-lethal projectile.

It is an object of the less-lethal force device to adjust the weight or mass of the less-lethal projectile based upon the weight, mass, velocity and or load of the lethal projectile.

It is an object of the less-lethal force device to increase the sighting groove of the docking station to allow for better visibility and accuracy of the firearm.

It is an object of the less-lethal force device to increasing the size of the hole on the docking station to allow gases to escape thereby preventing back pressure in the docking station. The vents can also be oriented to either retain the docking station or to expel the docking station depending upon re-using the docking station or using expendable docking stations, respectively.

It is an object of the less-lethal force device to potentially lengthening the whole projectile to give a longer distance of deceleration when the less lethal projectile impacts a target.

It is an object of the less-lethal force device to add fins for stabilization and accuracy of the less-lethal projectile. The fins can not only keep the projectile moving in a straight line condition, but can also be oriented to provide twisting of the less-lethal projectile as it travels.

It is an object of the less-lethal force device to add a pepper ball option that can further cause irritation to the target.

It is an object of the less-lethal force device to add a paintball or marker to the less-lethal projectile that will make it easier for law enforcement officers to identify an individual that was struck.

It is another object of the less-lethal force device to add a flash bang feature to the less lethal projectile to create temporary sight and or audible disorientation to a target.

It is another object of the less-lethal force device to adding a device that is able to bust open doors.

It is another object of the less-lethal force device to adding Taser-type prongs that can be connected to a Taser-like device that will increase the functionality of the less-lethal device after the less-lethal projectile has struck the target.

It is another object of the less-lethal force device to provide a holster that holds a firearm with or without the less-lethal device inserted onto the firearm.

It is another object of the less-lethal force device to provide a deep cavity in the less-lethal projectile to slow the lethal projectile as the lethal projectile enters into the less-lethal projectile to ensure complete nesting of the lethal projectile.

It is another object of the less-lethal force device to changing the shape of the metallic slug for the metallic slug to be more aerodynamic and therefore not allow the projectile to tumble as the non-lethal projectile travels to the target.

It is another object of the less-lethal force device for the docking station to be manufactured with a material that provide sufficient friction to retain the docking station of the firearm and also sufficiently retain the non-lethal projectile until it is desired to release the non-lethal projectile using the lethal projectile.

It is another object of the less-lethal force device to include a material/coating/anodizing on the slug instead of using an injection molding method to coat the slug.

It is still another object of the less-lethal force device to use a round ball-like less-lethal projectile for crowd control to allow the round ball-like projectile to bounce or roll around the crowd where a specific target is not easily identified.

It is still another object of the less-lethal force device to emit multiple ball sized projectiles from a single lethal projectile.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Figure 8:
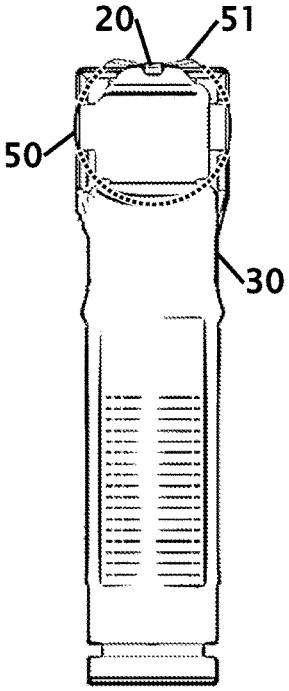

FIG. 8 shoes a rear assembled view of the less lethal projectile device mounted on a firearm.

Figure 9:
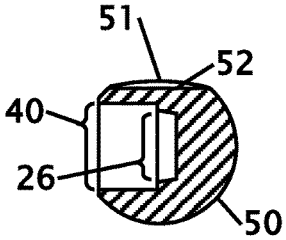

FIG. 9 shows a cross-sectional view of a less-lethal projectile device configured in second referred embodiment.

Figure 10:
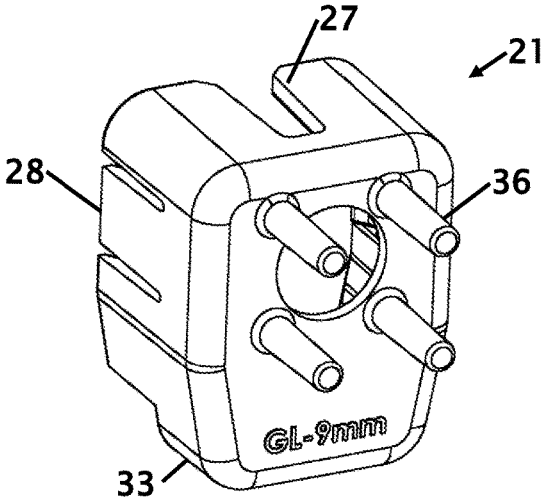

FIG. 10 shows a perspective view of the docking base configured with support pins.

FIG. 11 A-E show docking bases configured for different firearms.

Figure 12:
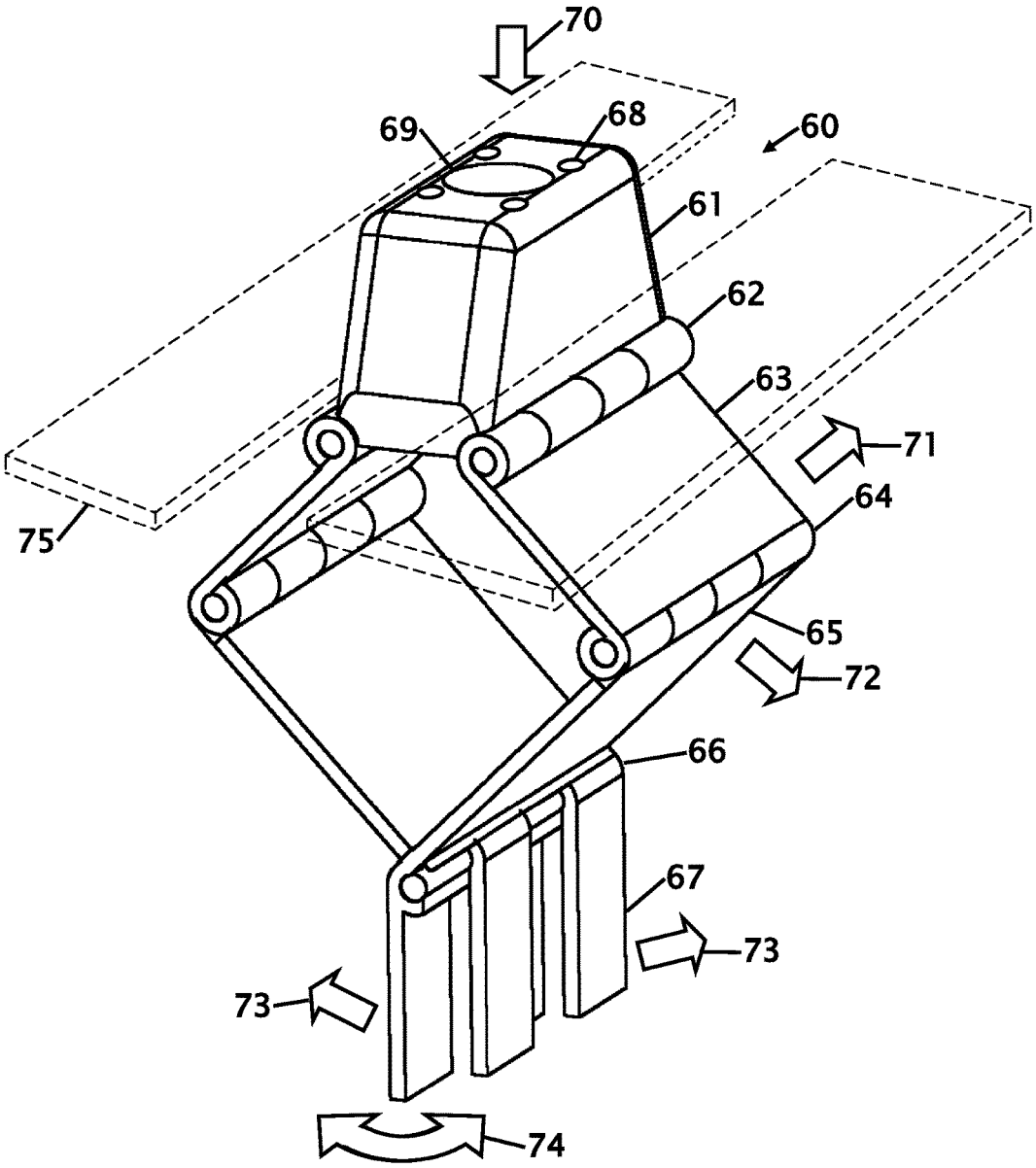

FIG. 12 shows a door breaching configuration.

DETAILED DESCRIPTION OF THE INVENTION

In operation, the fired bullet travels forward through the gun barrel towards the disclosed device. The bullet then leaves the barrel of the firearm, where a portion of the excess gas and energy generated during firing is harmlessly bled off, and immediately enters the mounting pins of the attached device. The bullet exits the mounting pins and is caught in the bullet trap portion of the projectile where it is slowed based upon the increase of mass between the projectile and the bullet trap.

The remaining kinetic energy of the bullet is transferred to the projectile, which is propelled forward, separating from the mounting pins and moving forward along the same line of travel as the bullet had taken. The projectile is now traveling at a lesser rate of speed and with less kinetic energy than the bullet had when it exited the barrel of the firearm. The speed and kinetic energy relationship is calculated into the design of the adjustable venting gasket and the vents on the mounting pins so as to bleed off a measured portion of the gas, taking into account the greater mass of the projectile and the projectile speed desired.

The docking base of the disclosed device is designed to clear from the firearm immediately following the departure of the bullet from the weapon. This action allows the weapon to instantaneously return to a lethal state in the event that the projectile misses its target or is ineffective in nullifying the threat, thereby making possible the application of lethality as necessary in an escalation of force situation. In another contemplated embodiment the docking base can remain on the firearm to allow for insertion of a subsequent non-lethal projectile.

Embodiments of the disclosed device may also be employed to breach semi-substantial barriers (i.e. windows, doors, light barricades) ahead of the delivery of chemical agents such as CS, CN, or Oleoresin *Capsicum* (pepper spray) as well as deliver chemical agents within the projectile, multiple ball sized projectiles or for the conveyance of leader filament attached to a docking line or rescue rope. Further embodiments may also be configured with field-adjustable vents to allow the officer to adjust the projectile speed at the point of use. Additional option such as but not limited to a flash bang, door bursting option, smoke grenade, bullet grenade, bullet propelled grenade (BPG), Bullet propelled device (BPD), grenade launcher, tear gas, door breaching, Taser-like prongs, and round ball-like alternative for crowd control features can be available options or features as an available arsenal of converting a lethal weapon to other non-lethal forms of the weapon by simply adding a docking station.

Variants of disclosed designs may include production of different models to accommodate a wide variety of specific firearms for use, with the disclosed system. Design considerations may include the caliber and weight of the ammunition, and the overall energy characteristics of the bullet fired from that particular weapon, as well as the desired projectile speed.

As a result of the disclosed system, the combination of the larger mass, increased cross sectional area, and the cushioned nature of the projectile, coupled with the reduced speed/kinetic energy of the projectile results in a normally lethal weapon being converted into a less-lethal blunt impact system.

Figure 1:
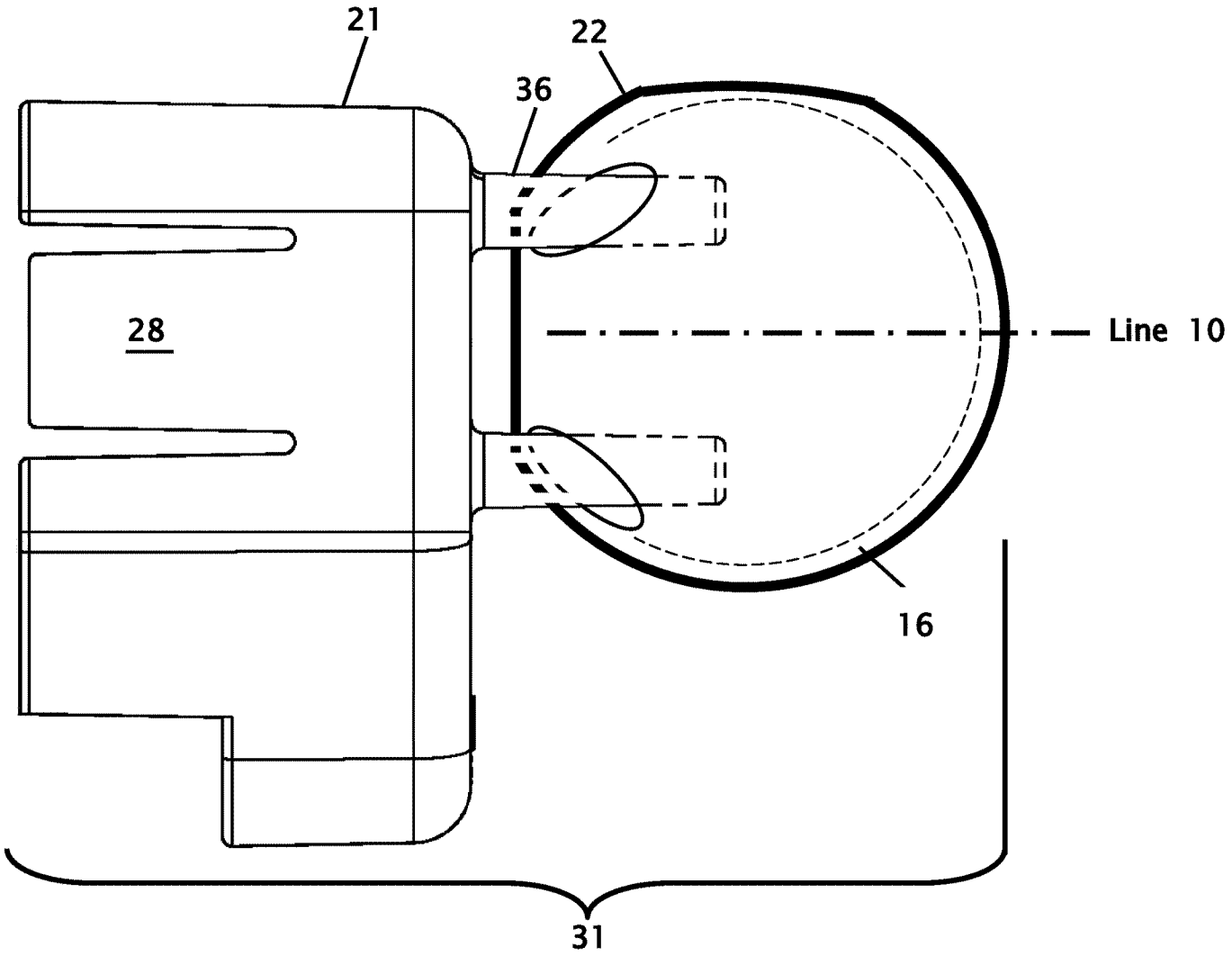
FIG. 1 is a side view of less-lethal projectile device configured in accordance with the teachings of this disclosure.

Referring first to FIG. 1, a side view of a less-lethal device 31 configured in accordance with the teachings of this disclosure is shown. The device 31 includes a docking base 21, a mounting pins 36, and a projectile 22. FIG. 1 also shows a compression/expansion tab 28 that is formed into docking base 21 for providing a compression force to releasably attach the base to the barrel of a firearm, as will be more fully disclosed below herein. The components of the device 31 are preferably aligned along an axis Line 18, defined by the trajectory of a bullet passing the device 31.

The docking base can have vents and or an optional adjustable rubber venting gasket that are preferably configured to relieve pressure in such a manner as to prevent the projectile from prematurely being launched. As will be appreciated by those of ordinary skill in the art, the interior of the barrel is at normal atmospheric pressure prior to the firing of the bullet. After firing, the bullet travels forward and compresses this atmosphere, possibly resulting in the projectile being forced off the tube prior to the bullet being trapped in the bullet trap. Furthermore, as the seal between the bullet and the barrel is not absolute, some of the expanding gas leaks around the circumference of the bullet as the bullet travels through the barrel. This gas, along with the pressure being created in front of the bullet must be bled off or the projectile may become airborne before the bullet is captured and the kinetic force is transferred. The vents and gasket are preferably formed to allow enough pressurized gas to escape to facilitate the proper capture of the bullet by the projectile, thereby ensuring a consistent launch of the projectile. This escaping gas may be used to slightly pre-launch the projectile in order to preserve the kinetic energy of the bullet, and to facilitate maximum energy transfer of the bullet to the projectile. Consequently, as more gas energy is transferred to the projectile, the speed of the projectile will increase and the projectile will attain more knock-down power.

In this preferred embodiment the mounting pins hold the projectile slightly outside of the end of the barrel of the firearm. This allows the bullet to complete any rotations caused by the barrel of the gun. By allowing the bullet to enter the projectile outside of the barrel the trajectory is improved. This further allows the gunpowder to completely expel outside of the barrel without causing back pressure within the barrel.

Figure 2A:
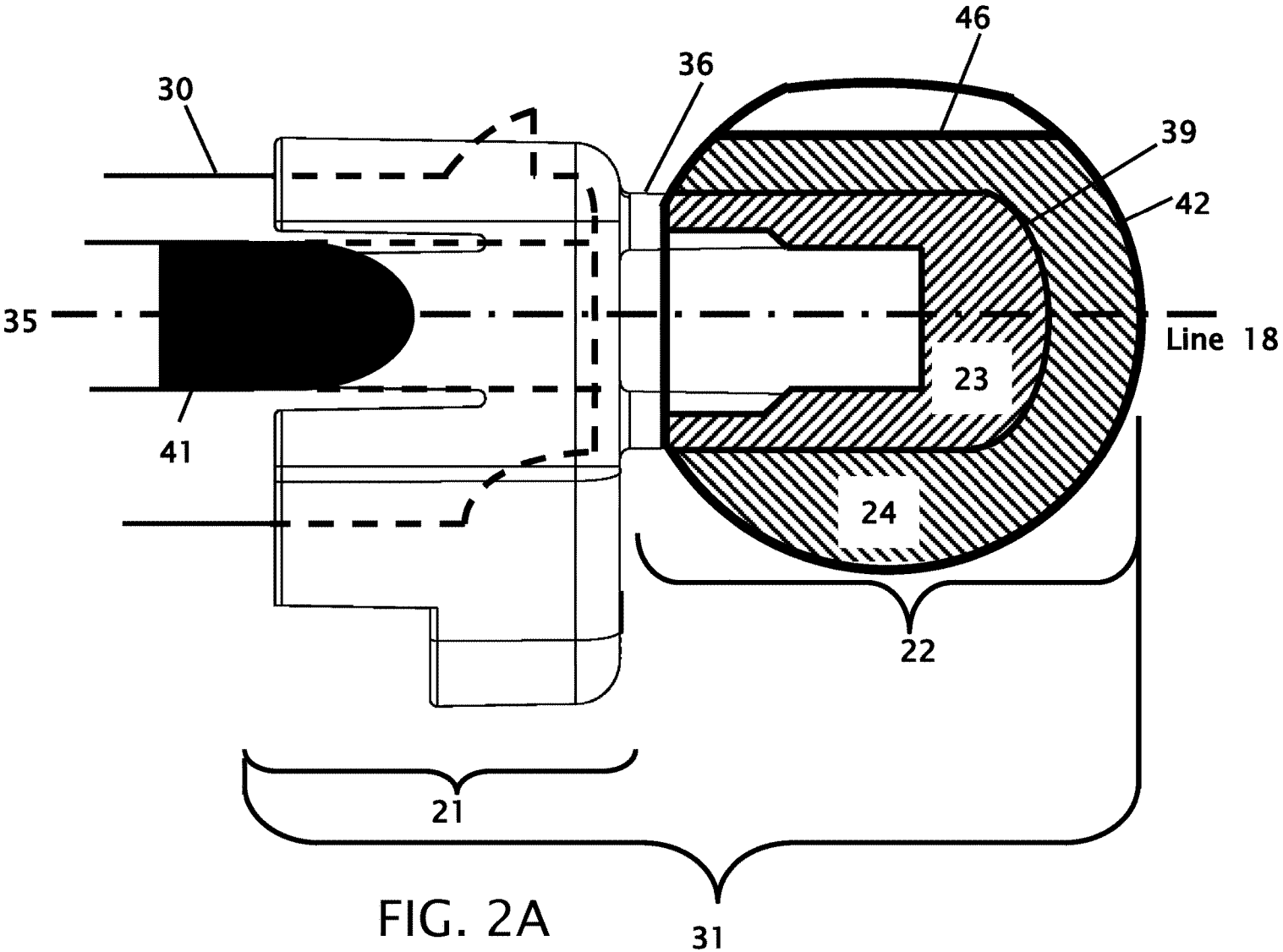
FIGS. 2A and 2B are cross-sectional views of a less-lethal projectile device configured in accordance with the teachings of this disclosure.
Figure 2B:
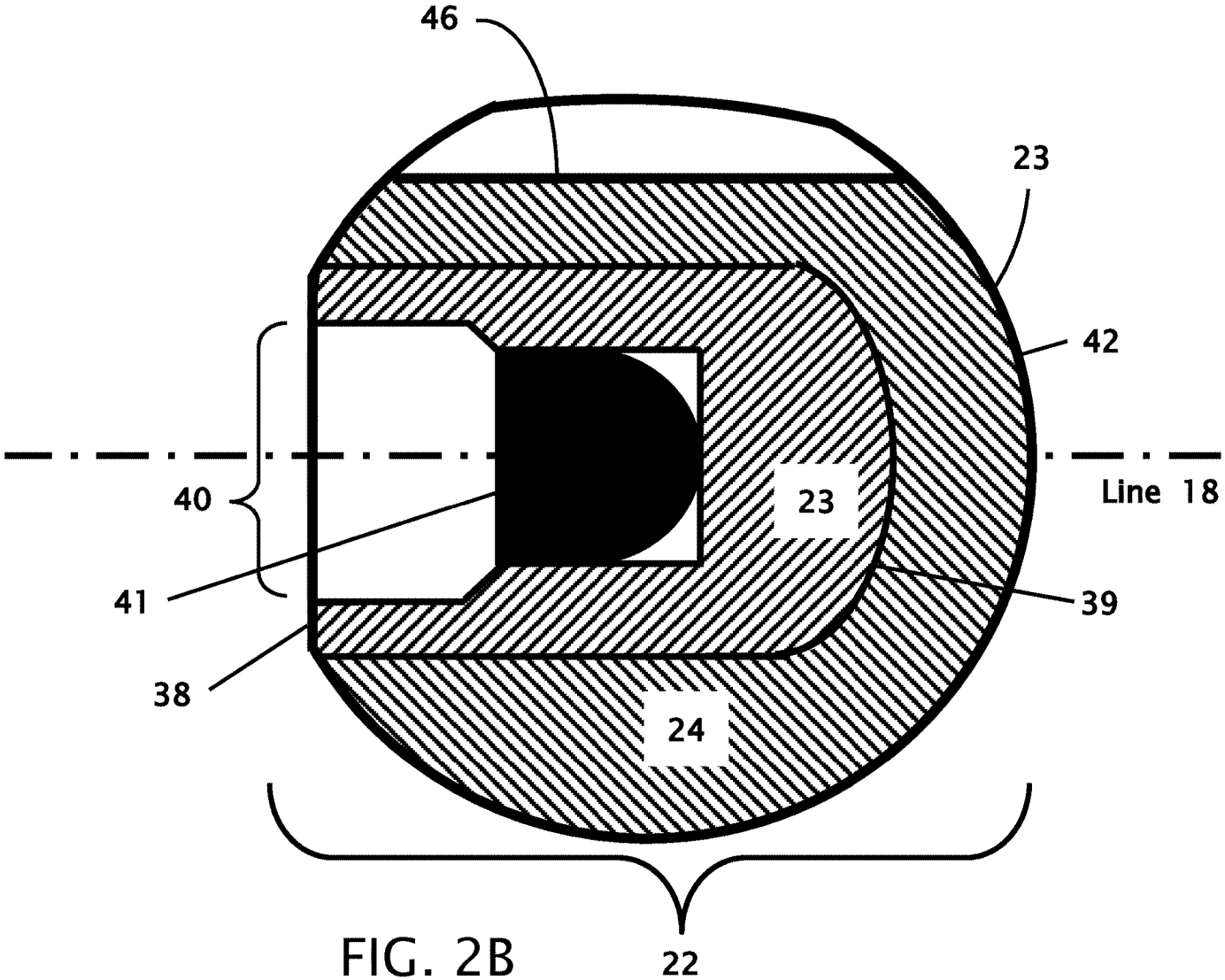

FIGS. 2A and 2B are cross-sectional diagrams of the less-lethal device 31 configured in accordance with the teachings of this disclosure. FIGS. 2A and 2B illustrate the device 31 in operation and illustrate to capture and launching of a bullet 41 along Line 18. A more detailed cross-sectional diagram of a projectile is shown in FIGS. 2A and 2B. In a preferred embodiment, the projectile 22 comprises a metal or rubber outer cushioning sleeve 16 formed over a cylindrical projectile block 23. The projectile block 23 may be formed from metallic or other like material and is preferably cylindrical in shape. The material of the projectile block 23 is metallic but other materials are contemplated that can absorb the bullet 41 without rupturing or causing hazardous damage. The slug can be metallic as well as other materials including but not limited to ceramics, composites. It is also contemplated that the projectile block can be fabricated with multiple materials where one material created added mass with the other material provides best absorption of the bullet 41.

The front surface 39 of the projectile block 23 and the front surface 42 of the rubber cushioning sleeve 16 are preferably formed in a rounded, aerodynamic, manner, shaped to reduce air resistance and increase stability during flight. It is also contemplate to configure the outer surface of the projectile 22 with fins or rifling to allow the projectile to spin along with the rifling of the projectile 41 as it travels through the barrel of the firearm 30. The outer surface or as a minimum the front surface 42 of the non-lethal projectile can be colored to identify that the weapon is less lethal thereby allowing other enforcement personnel and or the target to realize that the projectile is less lethal.

The optional sleeve or cover 16 is preferably formed from a material of sufficient density such that air resistance in flight will not alter its shape, yet the force will be minimized upon impact with a target so as to impart only blunt trauma to the target. The sleeve 24 may be glued or extruded onto the projectile block 23, and will extend the rear end 38 of the projectile block 23 to allow for impact cushioning should the projectile rotate during flight. It is contemplated that the sleeve or cover 16 may be formed of synthetic or natural rubber, urethane, of either the open or closed cell variety. A wide variety of materials may be utilized, with the type and thickness being chosen in relation to the desired impact and type of weapon utilized. The top of the projectile 22 has a recessed area 46 that serves as a relief for using the site of the firearm.

It is contemplated that a one-piece projectile may be employed in the present disclosure. For example, a one-piece projectile may be created for a specific purpose, such as knocking open a door or window, destroying a lock on a locker without having a bullet flying around inside the locker, or for the delivery of chemical agents into a closed space.

Figure 3:
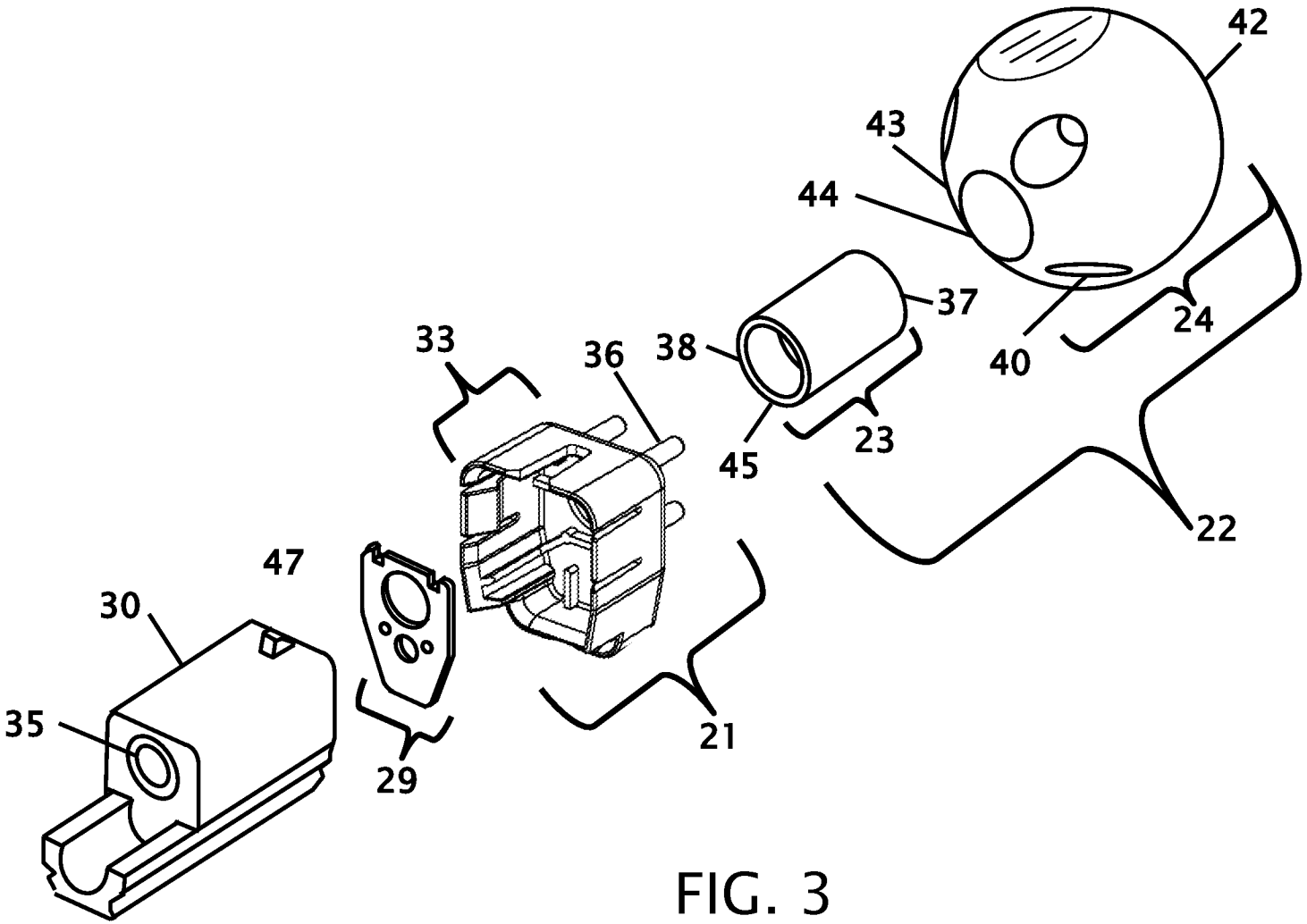
FIG. 3 is an exploded perspective view of a less-lethal projectile device configured in accordance with the teachings of this disclosure.

Referring briefly to FIG. 3, the rubber-cushioning sleeve 16 is shown as including a forward end 42 and a rearward end 43, with the cylindrical surfaces of the sleeve defining an interior cavity 44. FIG. 3 also shows that the projectile block docking base 23 includes a forward nose portion 37 and a rear portion 38 and further includes an interior cavity 45 formed therein.

FIG. 3 further shows that the sleeve 16 and the projectile block 23 are preferably assembled in a concentric fashion about the axis defined by Line 18 in FIG. 1, with the rubber cushioning sleeve 16 conformally covering the projectile block 23. The projectile block 23 may be disposed in the interior region 44 of the rubber cushioning sleeve 16 such that the rearward ends 38 and 43 of the projectile block 23 and rubber cushioning sleeve 16, respectively, are substantially aligned concentrically about the axis defined by Line 18. The rearward edge of 38 of the projectile block 23 may be inset within the rearward edge 43 of the rubber cushioning sleeve between 1/16 and 3/8 of an inch, based on the application and the attributes of the specific weapon.

Referring back to FIGS. 2A and 2B, the projectile block 23 includes an interior cavity 45 and a bullet trap 26 formed in the interior region of the projectile block 23 about the axis defined by Line 18. The interior cavity 45 is preferably formed proximate to the rearward end 38 of the projectile block 23. The rear-most portion of the pin mounting holes may be tapered, and is preferably formed to a diameter only slightly larger than the exterior diameter of the dock mounting pins 36, which may also be tapered, so as to create a snug male-to-female compression fit between the front end of the dock mounting pins 36 and the mounting holes or point 40 of the projectile 22.

A chamfer transition region 46 is formed between the block mounting point 40 of the projectile block 23 and the bullet trap 26 to further reduce the interior diameter along the length of the projectile block 23. The bullet trap 26 is formed about the axis defined by Line 18, and may vary in diameter depending on the caliber of bullet being fired from the weapon. The bullet trap 26 is preferably slightly larger in diameter than the caliber of the bullet and specifically shaped to allow for some expansion of the bullet inside the trap at impact. This expansion allows a more gradual transfer of kinetic energy to the projectile, which both increases the accuracy of the device, and decreases the launch energy, or "kick" transferred to the shooter. The front nose 37 of the projectile block 23 is preferably shaped so as to minimize damage to the rubber-cushioning sleeve 16 on both acceleration and impact.

FIGS. 2A and 2B also illustrate the sequence of events representing the operation of the disclosed device. The device utilizes the kinetic energy of a bullet 41 fired directly from the firearm 30 into the device of this disclosure that has been attached proximal to the barrel 35 of the firearm 30. As the bullet 41 leaves the barrel 35 of the firearm 30 along the path Line 18, it enters between the mounting pins 36 of the device, where a portion of the gas pushing the bullet 41 forward may be bled off via optional venting gasket and exits through optional gas exhaust vents as shown and described ion FIGS. 3 and 4.

The mounting pins 36 may be formed with the base as a single unit, and thus made of the same material. The bullet 41 then exits the mounting pins 36 in FIG. 2A, and enters the attached projectile 22 of FIG. 2B, where it is caught in the bullet trap 26 formed into the interior cavity of the projectile block 22. When the bullet 41 is captured in the bullet trap 26, the forward kinetic energy of the bullet 41 is transferred to the projectile 22. The projectile 22 then separates from the forward end of the mounting pins 36, and takes flight along the same path of travel Line 18 as the bullet had previously followed.

In flight, the projectile 22 now includes the mass of the bullet 41, plus the combined mass of the projectile block 23 and the rubber-cushioning sleeve 16. This heavier, blunted projectile, having been accelerated with a decreased kinetic energy and having an increased cross-sectional area, contributes to the transformation of the lethal penetrating energy of the bullet into a less lethal blunt force device. The captured bullet in the projectile 22 thus becomes a less-lethal projectile.

It is contemplated that a wide variety of projectile configurations may be used in the present disclosure. One design criterion is the weight ratio of the projectile and bullet combination. Exemplary ratios will now be disclosed.

As will be appreciated by those of ordinary skill in the art, pistol bullets typically range in mass from 90 to 250 grains, with most in the 115 to 230 grain range with a typical load for a 9 mm being about 124 grains. In one preferred embodiment, the projectile block 23 of this disclosure ranges from 1 to 2 ounces (480 to 960 grains), and the rubber-cushioning sleeve 16 is a formed rubber cover weighing approximately 0.5 ounce, for total projectile weight of approximately 1.5-2.5 ounces.

In preferred embodiments, the projectile may range from approximately 1 to 100 times the mass of the bullet of the firearm. It is contemplated that this ratio imparts an effective less-lethal knockdown force on the target.

It is contemplated that the disclosed ratios may also apply to rifles as well as revolver-type pistols. However, in the case of rifles, there is no movement of the top slider to cause the docking base to auto-eject, and consequently it will have to be removed from the end of the barrel manually. Further embodiments of this device for rifles and more specialized weapons may utilize a combined docking base/projectile to eliminate the need for manual removal of the docking base from the barrel of the weapon.

Referring generally now to FIG. 3, the exploded perspective diagram of a less-lethal projectile system. The figure shows the rear portion 33 of the docking base 21 being configured and shaped to removably attach to the exterior surface a firearm 30. Optional adjustable rubber venting gasket 29 is shown between the forward portion the firearm 30 and the docking base. It is contemplated that the optional adjustable optional rubber venting gasket 29 may be formed of synthetic or natural rubber, urethane, of either the open or closed cell variety, or of a wide variety of rubberized compounds, with the type, thickness, size, presence, and location of vents being chosen in relation to the desired impact and type of weapon utilized. This gasket may be constructed in such a manner as to allow more of the exhaust gasses to exit through optional exhaust gas vents that reduce heat build-up within the firearm and or the docking base 21.

Figure 4:
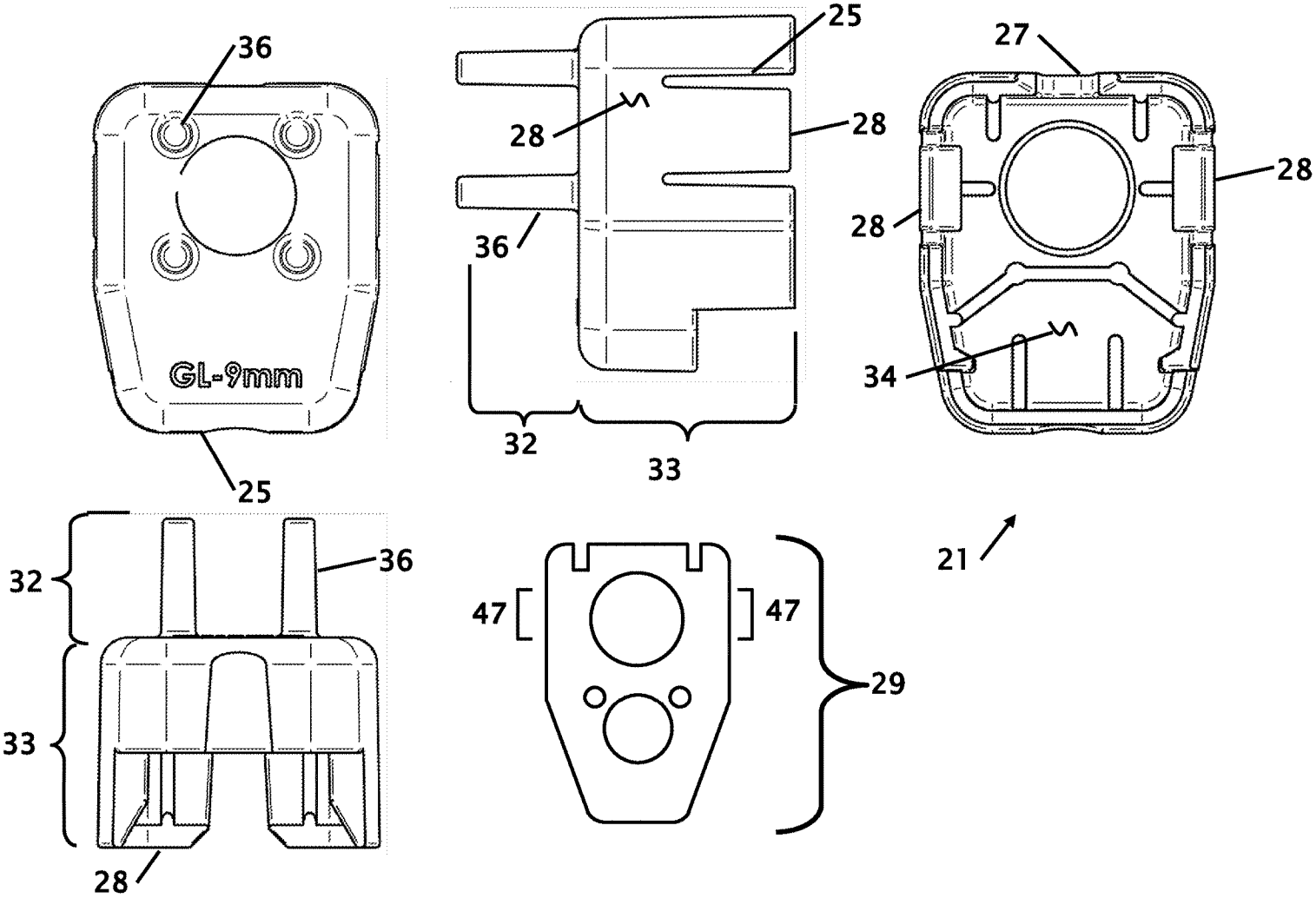
FIG. 4 is a set of 4 perspective views of the docking base and one view of the adjustable venting gasket. These views depict the compression/expansion tabs and the dock vents and gasket venting areas in accordance with the teachings of this disclosure.

The gas exhaust vents 25 (as shown in FIG. 4) and the rubber venting areas 47 of the optional adjustable rubber venting gasket 29 are preferably provided in such a size and number so as to bleed off a certain portion of the expanding gasses created by the combustion of the gunpowder in the shell and the compression caused by the traveling bullet as described above.

These vents can be specially manufactured to create. For example, in testing using a .45 caliber 230 grain round, traveling at 815 feet per second (FPS) and a 2 ounce projectile, projectile speed varied from 240 FPS and 122 PSI (no gasket-four _" vent holes in the mounting tube) to 245 FPS and 128 PSI (no gasket-two _" vent holes in the mounting tube) to 250 FPS and 133 PSI (no gasket-no vent holes on the mounting tube) to 255 FPS and 138 PSI (gasket with two _" lots in the venting areas and no vents in the mounting tube) to 260 FPS and 144 PSI (full gasket, no slots in the venting areas and no vents in the mounting tube). Likewise, similar results were obtained in testing a 9 mm 115 grain round, traveling at 1160 feet per second (FPS) and a 2 ounce projectile, projectile speed varied from 215 FPS and 89 PSI (no gasket-four _" vent holes in the mounting tube) to 220 FPS and 92 PSI (no gasket-two _" vent holes in the mounting tube) to 225 FPS and 97 PSI (no gasket-no vent holes on the mounting tube) to 230 FPS and 101 PSI (gasket with two 11/64" slots in the venting areas and no vents in the mounting tube) to 240 FPS and 110 PSI (gasket with two slots in the venting areas and no vents in the mounting tube) to 245 FPS and 115 PSI (full gasket, no slots in the venting areas and no vents in the mounting tube). For comparison purposes a typical 12 gauge shotgun deployed 1.4 ounce beanbag round, traveling 300 FPS generates 134 PSI. The variable energy values obtained through the different venting options available with this device make it deployable in a greater range of situations and with more convenience than the typical less-lethal device.

Referring more specifically to the docking base 21, it is contemplated that the docking base and tube 21 may be formed from a plastic or similar material, and serves as a collar, which is designed to snuggly attach to a firearm. Variants of the docking base 21 may be manufactured for a particular model of firearm so as to maintain alignment to the barrel of the firearm along the path defined by Line 18.

Referring generally now to FIG. 4. The rearward end 33 of the docking base 21 may include one or more compression/expansion tabs 28, formed into the base 21 to facilitate expansion and contraction of the rearward end of the docking base 33 so as to facilitate the removable attachment of the base 31 to the forward end of a firearm 30. The compression/expansion slots may be formed to extend radially outward from the inner region 34 of the base outward through the outer surface of the base 21, forming compression members in the rear portion 33 of the base 21.

The size of the interior cavity 34 of the docking base 21 is preferably formed so as to be slightly smaller than the outside surface of the firearm it is designed to fit, thereby requiring the outward flexing of the compression/expansion tabs of rear portion 33 when installing the base 21 onto a firearm. The number and size of these tabs may be determined by the amount of compression force necessary to reliably and accurately seat the base 21 onto a particular firearm, assuring that the device remains properly aligned and affixed to the firearm. The mounting pins 36 are shown in a round configuration, but it is also contemplated that the pins 36 can be configured as triangular, square or other multi-sided configuration where the corners of the shape are deformed to grasp the projectile.

The docking base 21 is preferably formed with a slot 27 designed to fit around the front gun sight without affecting the weapon's alignment or function. The docking station can also be fabricated to enhance the sighting capability of the firearm and may further include material that glows or includes a battery that is illuminated when the docking station is inserted onto a firearm.

It is also contemplated to include a paintball or marker to the less-lethal projectile that will make it easier for law enforcement officers to identify an individual that was struck.

A holster is also contemplated that can accommodate a firearm with or without the docking base and the less-lethal force device installed onto a weapon, thereby requiring a law enforcement person to turn the less-lethal device into a lethal device prior to firing the weapon.

Figure 5:
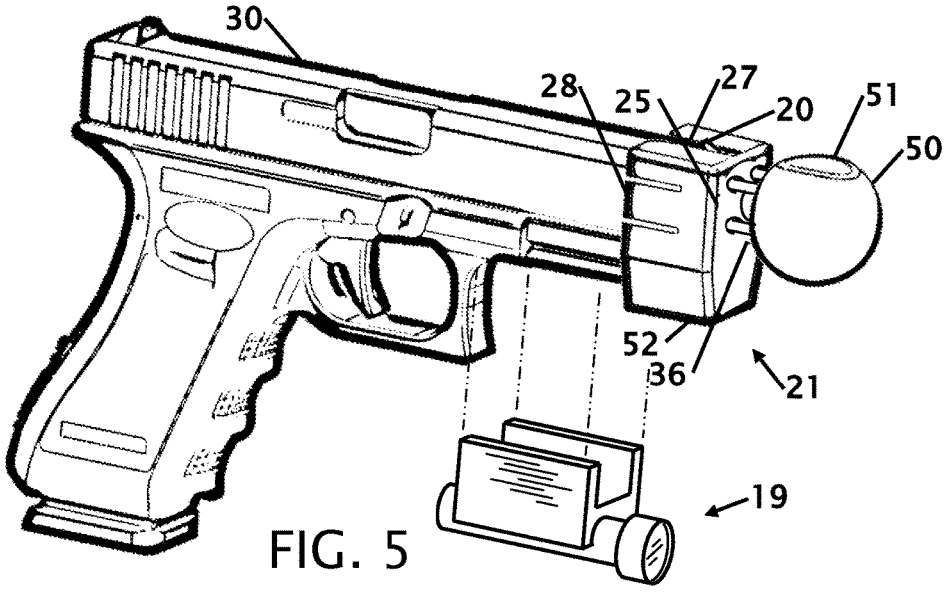
FIG. 5 shows a perspective assembled view of the less lethal projectile device mounted on a firearm.
Figure 6:
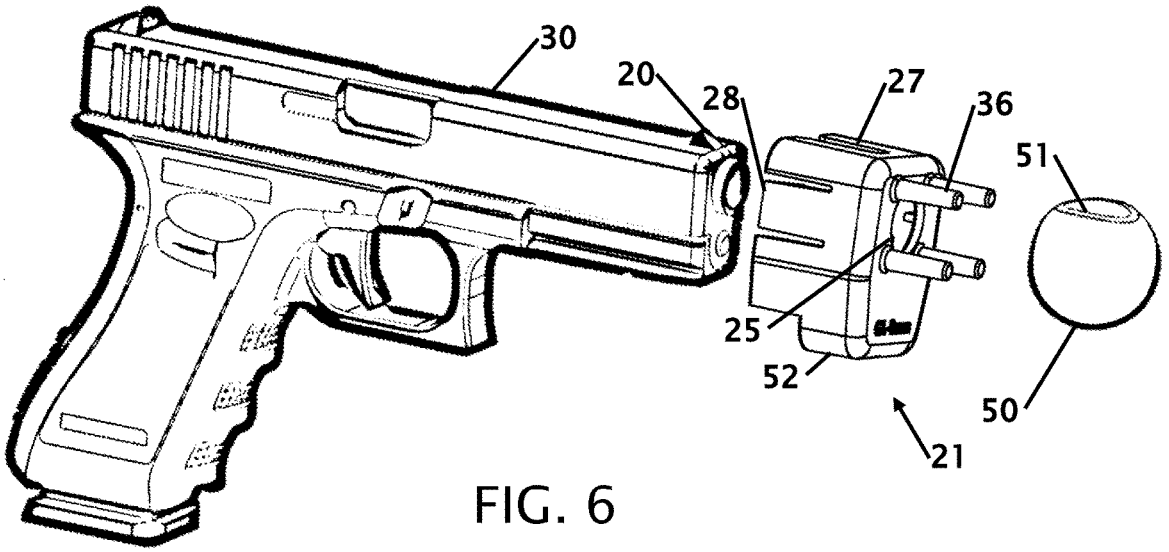
FIG. 6 shows a perspective exploded view of the less lethal projectile device mounted on a firearm.
Figure 7:
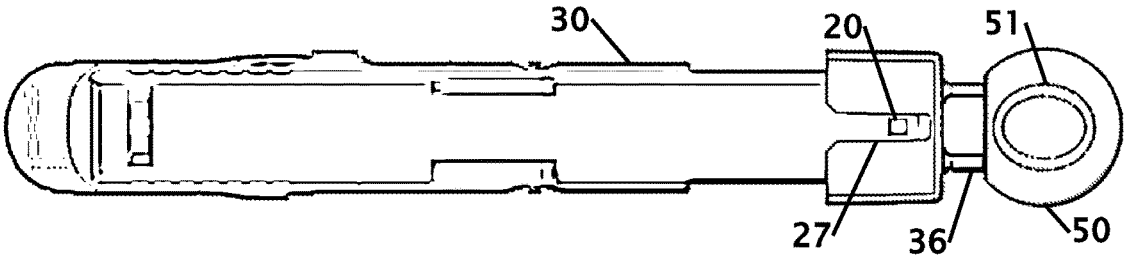
FIG. 7 shows an assembled top view of the less lethal projectile device mounted on a firearm.

FIG. 5 shows a perspective assembled view of the less lethal projectile device mounted on a firearm, FIG. 6 shows a perspective exploded view of the less lethal projectile device mounted on a firearm, FIG. 7 shows an assembled top view of the less lethal projectile device mounted on a firearm and FIG. 8 shoes a rear assembled view of the less lethal projectile device mounted on a firearm. In this embodiment, the projectile 50 is predominantly round and has a recessed area 51 that allows for use of the sighting system 20 of the firearm 30 to remain functional. The docking station 21 also has a recess 27 that allows the sighting system 20 of the firearm 30 to be useful. FIG. 5 also shows a flashlight 19 or laser sight that can be mounted to the underside of the firearm. The docking station 21 is designed to reduce obstruction for mounting the flashlight or laser sight 19.

The dock 21 for the firearm 30 has concave sides 28 that attach onto barrel of the revolver 30 and act as the docking station to the projectile 50. Once the bullet is shot the docking station 21 disengages from the revolver 30 and the bullet gets imbedded into the projectile 50. The exhaust gas vents 25 reduce heat build-up within the firearm and or the docking base 21 as the bullet exits the barrel of the gun and enters the mounting pins 36 and then the projectile 50.

In another preferred embodiment the docking system 21 is more permanently fixed to the firearm 30. Two concave sides 28 that clamp on both sides of the barrel use a magnetic coupling to maintain the docking station 21 on the firearm 30. This docking station 21 allows bullets to pass through the muzzle unobstructed, but still allow the projectile 50 to mount on the dock 21.

In another contemplated embodiment the docking station 21 is permanently fixed or manufactured with the firearm 30. In this embodiment the docking system would be similar to the embodiments shown and described herein, but on the lower section 52 of the docking station a mechanism allows the docking station 21 to attach to a rail system similar to a mounting of a flashlight on a police pistol. This would allow the firearm 30 to cycle properly while allowing bullets to feed from the magazine to the chamber without any obstruction. This also does not affect the action or the dispensing of the empty cartridge.

FIG. 9 shows a cross-sectional view of a less-lethal projectile device configured in second referred embodiment. In this embodiment the projectile 50 is made from a homogeneous material. The projectile 50 mounts onto mounting pins 36 of the docking station. The bullet trap 26 captures the fired bullet and spreads the impact area of the bullet over the larger surface area of the projectile 50. The top portion of this cross section shows the recessed area 51 and the lowered center section 52 that allows for use of the sighting mechanism of the firearm.

FIG. 10 shows a perspective view of the docking base 21 configured with support pins 36. In this embodiment, a cavity of the projectile fits around the supporting pins 61 of the docking base 21. The docking station 21 has a recess 27 that allows the sighting system of the firearm to be useful. The docking station 21 has concave sides 28 that attach onto barrel of the revolver. Under tab 33 supports the docking station from under the firearm. The use of the support pins 36, as opposed to a mounting tube, impart less frictional resistance to the projectile to increase accuracy and also enlarges the exhaust port to improve cooling of the firearm and the docking station.

Figure 11A:
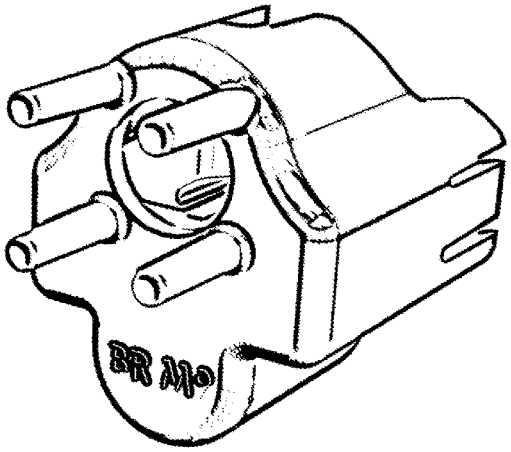
Figure 11B:
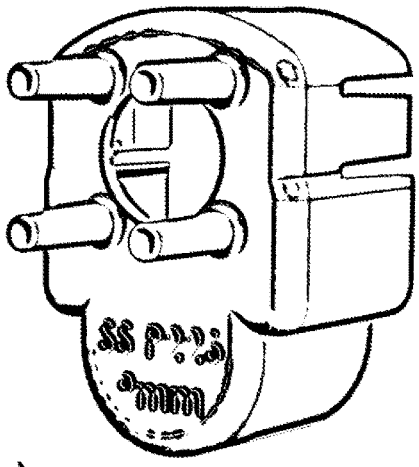
Figure 11C:
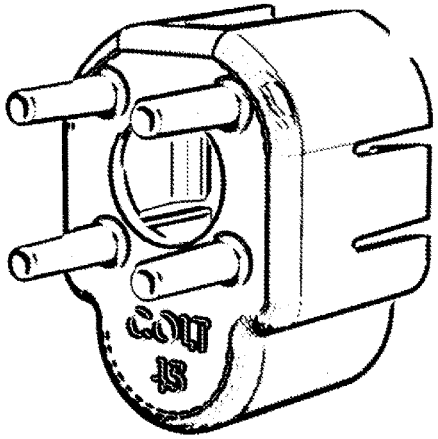
Figure 11D:
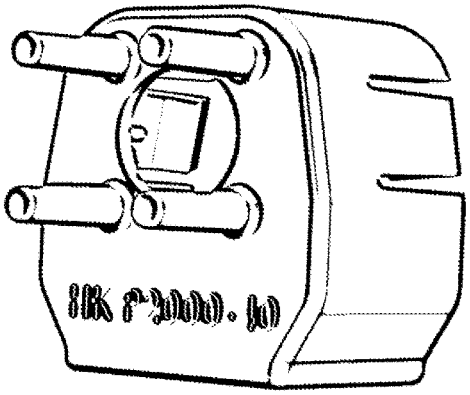
Figure 11E:
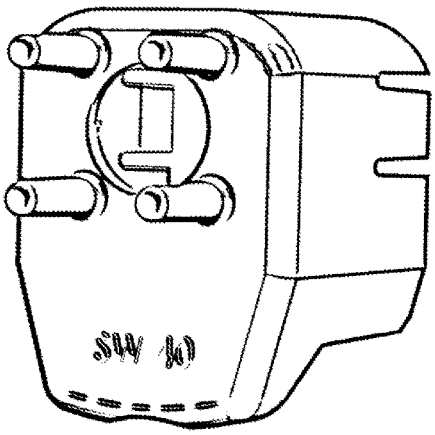

FIG. 11A shows a mounting base for a Beretta M9. FIG. 11B shows a mounting base for a SS P226. FIG. 11C shows a mounting base for a Colt IV 45. FIG. 11D shows a mounting base for a HK P2000. FIG. 11E shows a mounting base for a SW 40 MP. While these mounting bases are shown for specific firearms, mounting for other firearms and bullets are contemplated, including but not limited to 5.56 (223), 7.62 (308), 338 Lapua and Magnum. The mounting base can further be configured as a flash suppressor that approximates the same weight as the stock. It is further contemplated that the mounting base can be a permanent attachment to a firearm. In another contemplated embodiment the mounting base can be configured as a shotgun choke.

FIG. 12 shows a door breaching configuration 60. In this configuration the receiver 61 has a holes 68 for receiving the pins of a docking base. The firearm with the receiving base is mounted to the door breaching configuration 60. The spreading tabs or bars 67 of the door breaching configuration 60 are then placed into a door jamb hinges or latch bolt and the firearm is discharged it pushed down 70 into the receiver 61. The bullet is received into receiver 61 into hole 69. The downward force 70 moves through hinge 62 and pushes first arm 63 out 71. The force is then transferred through hinge 64 that moves the second arm 65 outward 72. The outward force 72 transfers through hinge 66 to spread the expansion arms or tabs 67 outward 73. This spreads 74 the arms or tabs to breach a door. It is contemplated that a shield 75 can be incorporated to prevent or reduce destroyed parts of the breached door from being blown-back to the person(s) breaching the door.

Thus, specific embodiments of a less-lethal force device have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A less-lethal force device comprising:

a docking station having a rear portion and a forward mounting portion, the rear portion being adapted to removably attach the base to the barrel of a firearm and receive a fired bullet from a firearm along a path defined by a travel of a bullet;

said forward mounting portion having mounting pins that are forward of said docking station for clear passage of said bullet along a path defined by a travel of said bullet;

a projectile having an interior cavity and enveloping said mounting pins of said forward portion along said path defined by a travel of a bullet;

said projectile being configured to capture said fired bullet into said interior cavity in a bullet trap, and detach from said forward portion mounting pins as a result of kinetic energy transferred to said projectile from said fired bullet, and be accelerated along said path defined by a travel of said bullet to impart a less-lethal force upon a target, and said projectile is selected from a group comprising of a flash bang, a smoke grenade, a bullet grenade, a bullet propelled grenade (BPG), a bullet propelled device (BPD), a grenade launcher, a tear gas grenade, a door breaching device and Taser prongs.

2. The less-lethal force device according to claim 1 wherein said projectile is surface treated to allow for continued rotation of said bullet after said bullet leaves said firearm.

3. The less-lethal force device according to claim 1 wherein said docking station is expelled from said barrel of said firearm after said projectile is detached from said forward portion mounting tube.

4. The less-lethal force device according to claim 1 wherein said mounting pins retain said projectile in front of said barrel of said firearm.

5. The less-lethal force device according to claim 4 wherein said mounting pins suspend said projectile to allow said bullet to exit said barrel before entering said projectile.

6. The less-lethal force device according to claim 5 wherein said bullet travels in free space from said barrel, between said pins before entering said projectile.

7. The less-lethal force device according to claim 6 wherein at least some exhaust gasses exhaust behind said bullet prior to said bullet entering said projectile.

8. The less-lethal force device according to claim 1 wherein said adapter does not create head pressure in front of said bullet.

9. The less-lethal force device according to claim 1 wherein said adapter does not create an increase of head pressure within said barrel.

10. The less-lethal force device according to claim 1 wherein said projectile does not create an increase of head pressure within said barrel.

11. The less-lethal force device according to claim 1 wherein there are at least two mounting pins.

12. The less-lethal force device according to claim 11 wherein there are four mounting pins.

13. The less-lethal force device according to claim 1 wherein said docking station is configured to be kicked off of a firearm as a result of the recoil of the firearm.

14. The less-lethal force device according to claim 1 wherein said projectile comprises a bullet trap formed in an interior cavity for capturing a fired said bullet.

15. The less-lethal force device according to claim 1 wherein said projectile comprises an outer cushioning means formed over said projectile.

16. The less-lethal force device according to claim 1 wherein said bullet trap is slightly larger in diameter than the caliber of the bullet and configured to allow for expansion of the bullet inside said bullet trap at impact of said bullet within said bullet trap.

* * * * *